US008641580B2

(12) United States Patent
Bellerive

(10) Patent No.: US 8,641,580 B2
(45) Date of Patent: Feb. 4, 2014

(54) SWIMMING EXERCISING DEVICE

(76) Inventor: Donald Bellerive, Fort Myers, FL (US)

( * ) Notice: Subject to any disclaimer, the term of this patent is extended or adjusted under 35 U.S.C. 154(b) by 436 days.

(21) Appl. No.: 12/928,246

(22) Filed: Dec. 7, 2010

(65) Prior Publication Data

US 2011/0136629 A1 Jun. 9, 2011

Related U.S. Application Data

(63) Continuation-in-part of application No. 12/460,484, filed on Jul. 20, 2009, now Pat. No. 7,846,072, which is a continuation-in-part of application No. 12/008,314, filed on Jan. 10, 2008, now Pat. No. 7,563,206.

(51) Int. Cl.
*A63B 31/00* (2006.01)
*A63B 21/04* (2006.01)

(52) U.S. Cl.
USPC ..... 482/55; 482/129; 434/254

(58) Field of Classification Search
USPC ..... 482/55–56, 33; 434/254; 411/55, 21, 411/348
See application file for complete search history.

(56) References Cited

U.S. PATENT DOCUMENTS 3,981,500 A * 9/1976 Ryan ..... 248/274.1
4,095,657 A * 6/1978 Hohwart ..... 482/55
4,524,711 A * 6/1985 Ashrow ..... 482/55
4,530,497 A * 7/1985 Moran et al. ..... 482/55
5,611,763 A * 3/1997 Lochbaum ..... 482/111
5,711,331 A * 1/1998 Harris ..... 135/16
5,743,283 A * 4/1998 Horvath ..... 135/16
5,846,167 A * 12/1998 Liu et al. ..... 482/55
6,176,815 B1 * 1/2001 Riera ..... 482/55
7,055,807 B2 * 6/2006 Pesta ..... 256/65.14
7,185,598 B1 * 3/2007 Lan et al. ..... 114/215
7,442,151 B1 * 10/2008 Berdegue ..... 482/55
7,563,206 B1 * 7/2009 Bellerive ..... 482/55
7,846,072 B1 * 12/2010 Bellerive ..... 482/55
2005/0095079 A1 * 5/2005 Beckers ..... 411/348
2006/0287166 A1 * 12/2006 Alvarez ..... 482/55

* cited by examiner

*Primary Examiner* — Stephen Crow

(57) ABSTRACT

Individual swimmers may routinely and easily perform exercise regiments to maintain or enhance their general health and fitness utilizing the present invention. A pole may be secured adjacent a body of water to retain a tether and a harness which retains the swimmer. Numerous pole mounting arrangements provide for deployment of the swimming exercise device with nearly any configuration of swimming pool without regard for whether the pool is of the in ground style or of the above ground style and without regard for size from the smallest available to Olympic size. A small but durable hand rail mount and a water filled anchor which merely sits adjacent the body of water provide for excellent securement of the pole without any structural modification to any existing structure.

9 Claims, 12 Drawing Sheets

FIG. 6a
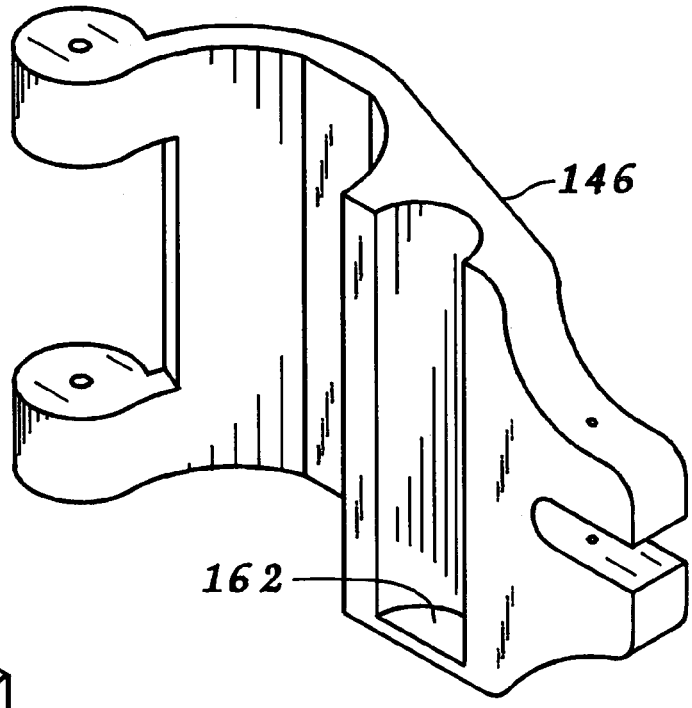
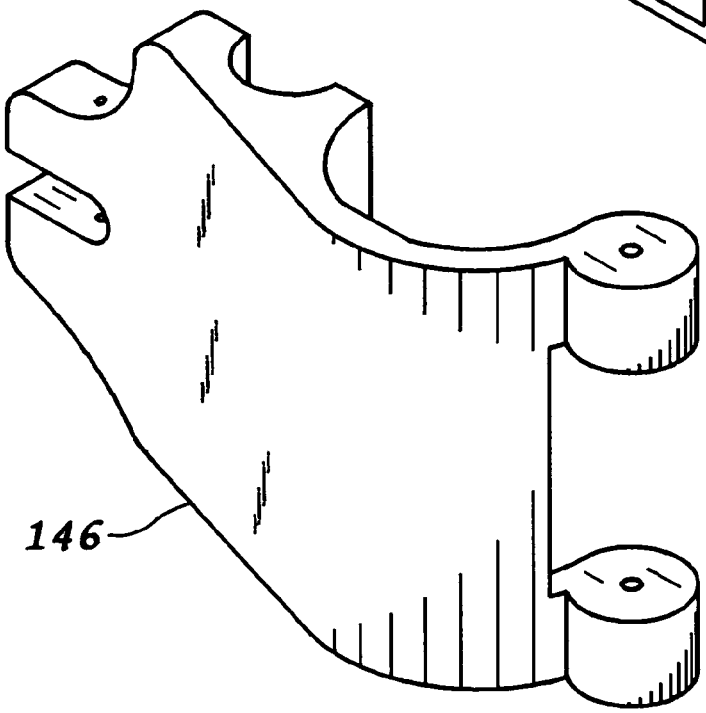
FIG. 6b

FIG. 7a
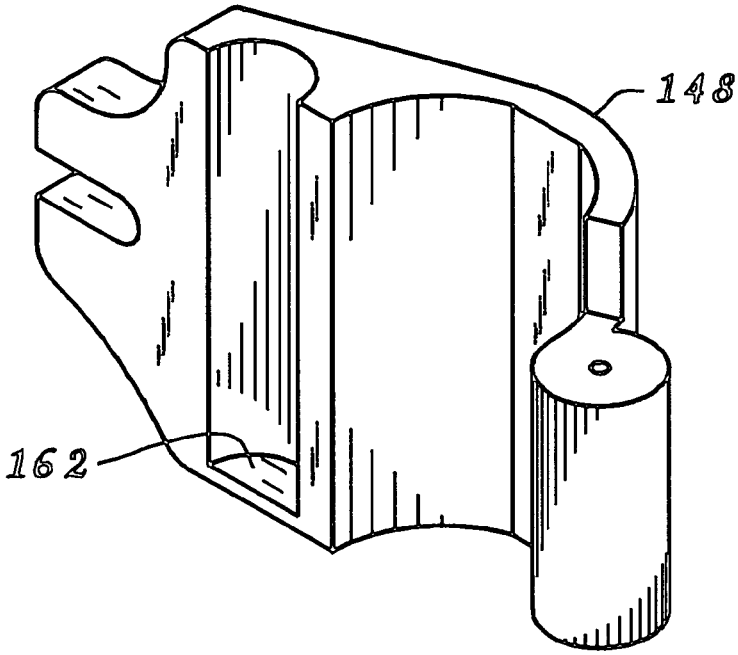
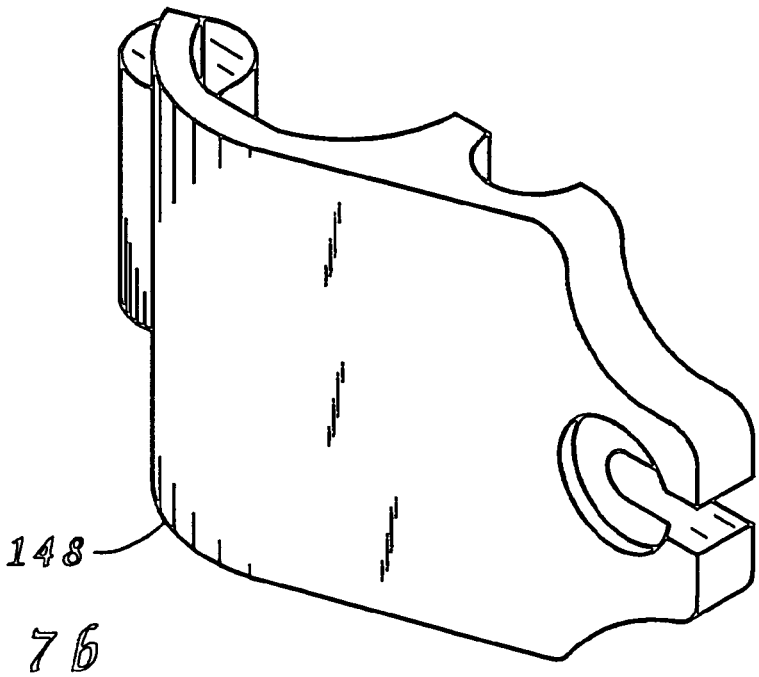
FIG. 7b

FIG. 10
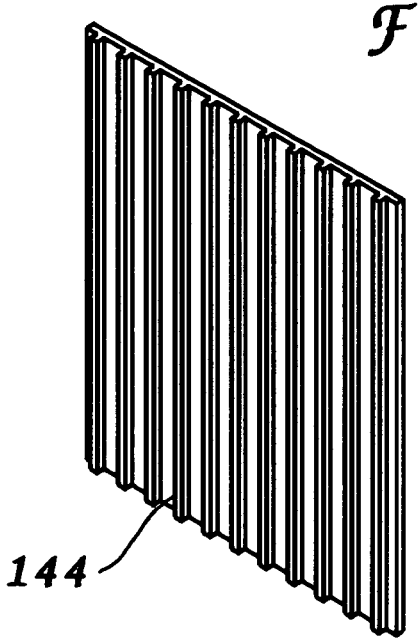
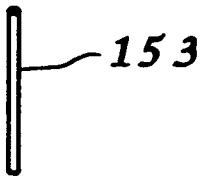
FIG. 11
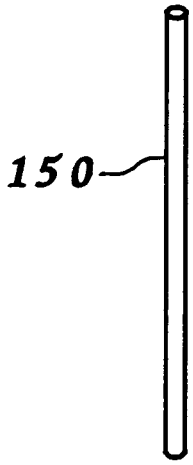
FIG. 12

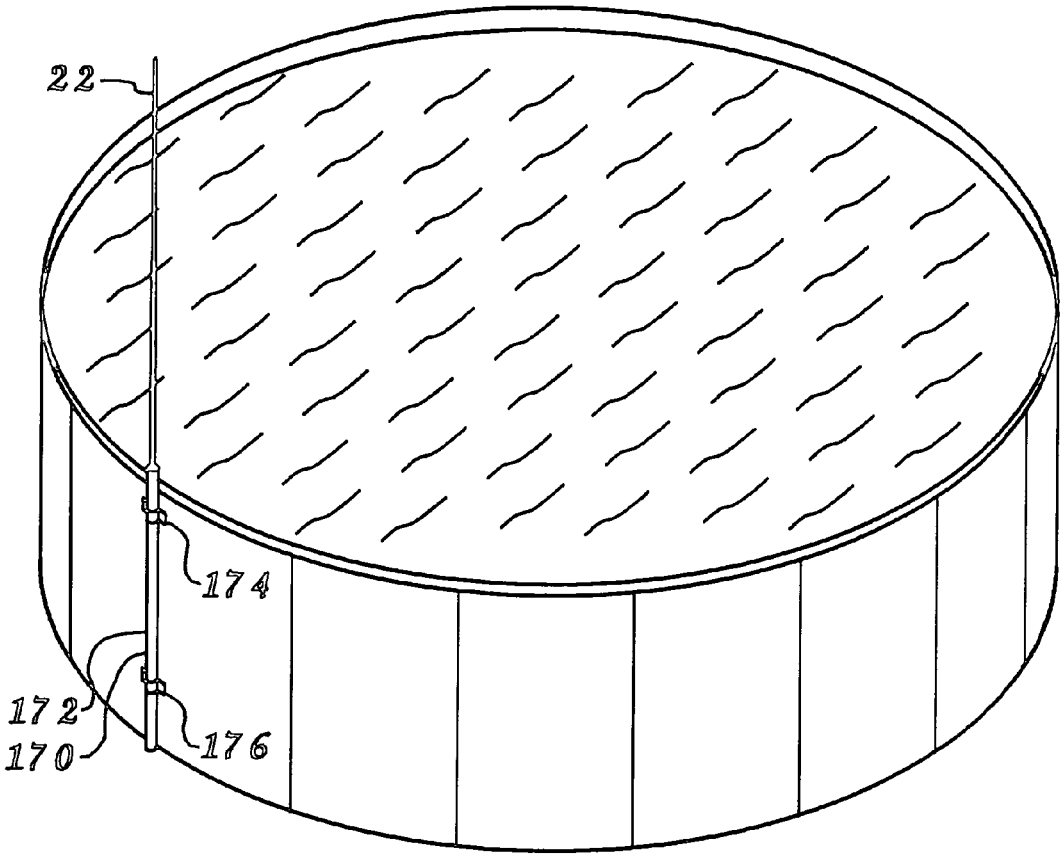
FIG. 14
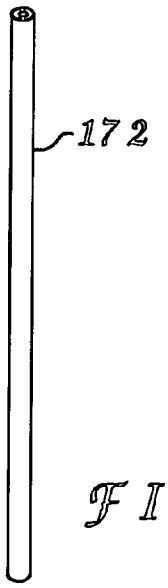
FIG. 15
FIG. 16
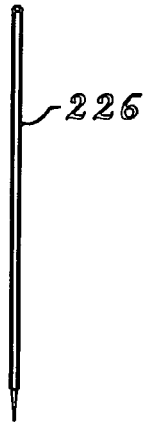

SWIMMING EXERCISING DEVICE

CROSS-REFERENCE

This application is a continuation-in-part of Ser. No. 12/460,314 filed Jul. 20, 2009, currently pending, which was a continuation-in-part of Ser. No. 12/008,314 filed Jan. 10, 2008, now U.S. Pat. No. 7,563,206. The original applications are incorporated herein by this reference.

BACKGROUND

1. Field of the Invention

Generally, the invention relates to exercise devices which permit a swimmer to be retained in a generally stationary position within a body of water, such as a swimming pool, during performance of a conventional swimming action. More specifically, the invention relates to anchors for poles of such exercise devices.

2. Description of the Prior Art

Numerous methods exist to exercise portions of the human body. Certain devices have been proposed which provide for the person performing the associated exercise to be in water. It has long been known that swimming is one of the very best forms of exercise. Many types of 'strokes', or swimming styles, are known in conventional swimming. Some of these utilize movement and exertion of the arms more than that of the legs. Some of these utilize movement and exertion of the legs more than that of the arms. Some of these utilize movement and exertion of both the arms and legs. During swimming, even through the arms and legs may appear to be performing most of the action, many muscles of the body are utilized. Therefore, a full body workout can be obtained by swimming for a reasonable period of time.

Swimming is considered by many in the medical and physical fitness fields as a nearly perfect exercise for nearly all persons regardless of age or general physical condition. Unlike running, or even walking, there is no impact delivered to the feet and legs, including all of the joints contained therein, during swimming. Additionally, many styles of swimming simultaneously exercise both the arms and legs during performance of the respective swimming action. Certain land based exercise routines, such as jumping jacks, exercise both the arms and legs simultaneously but typically such exercises due not provide desirable resistance to the limbs during performance of the exercise. Water is the ideal medium for exercise due to the nature of the water and the natural resistance to motion of objects through water. During swimming the swimmer may merely increase their speed of completing each cycle of a stroke to increase the resistance of the exercise. Additionally, during swimming it is easy to change from one selected style of swimming to another style of swimming to vary the workout routine.

The fundamental problem with swimming as an exercise involves the fact that most Americans which routinely swim as an exercise do so in a swimming pool. Therefore, the swimmer will swim from one end of the pool to the opposing end, then turn one hundred and eighty (180) degrees and swim back to the then opposing end. This cycle will then be performed repetitively for the duration of the exercise routine. This constant contact with, or at least approach to, the hard perimeters of the opposing ends of the pool have obvious inherent dangers. Many swimming styles have the swimmer's face down into the water which is raised out of the water to breath and to look forward, if desired. Other swimming styles have the swimmer's face facing upward toward the sky, such as during performance of the backstroke. For these reasons it is difficult for the swimmer to constantly remain aware of their spacial orientation with the perimeter of the pool that they are approaching during movement from one end to the opposing end. Many swimming pools, particularly those associated with a individual home, are relatively small. Additionally, some swimming styles require a depth of water greater than that of the shallow end of some swimming pools. Often the swimmer desiring to perform their exercise routine in a swimming pool will have other swimmers utilizing the swimming pool for their own recreational use. For all of these reasons many persons having access to a swimming pool will not utilize the pool to the fullest extent possible for exercise.

Applicant previously developed and patented, U.S. Pat. No. 4,530,497 issued Jul. 23, 1985, an exercising device which provides many of the benefits of stationary swimming exercise. Applicant has been successfully marketing products based upon applicant's earlier invention for many years. Applicant has recently made numerous improvements to his product line which are the subject matter of the present invention.

Various deficiencies exist with nearly all forms of exercise and devices to facilitate each respective form of exercise. Applicant's previous invention, and products based upon that invention, provide for the optimal exercise routine in an extremely safe manner. Various minor disadvantages exist with applicant's prior invention and products based upon that invention. These minor disadvantages are particularly related to shipping and distribution of such products and transport and storage of such products by the end user and retention of the pole relative to the body of water. As such, it may be appreciated that there continues to be a need for versatile methods of anchoring the pole adjacent the body of water. The present invention substantially fulfills these needs.

SUMMARY

In view of the foregoing disadvantages inherent in the known types of exercise devices, your applicant has devised a swimming exercise device for a swimmer to allow generally free movement of legs and arms during performance of a swimming action by the swimmer within a body of water. The performance of the swimming action occurring while the swimmer is being restricted to a generally stationary position in the body of water. The swimming exercise device has a pole, means to retain the pole, an engagement member and a connection member. The pole has a securing end, an outer end and a resilient flexibility along a portion of the pole at least near the outer end. The means to retain the pole providing for the securing end of the pole to be retained in a fixed position relative to the body of water. The engagement member contacts the swimmer while leaving the swimmer free to manipulate their legs and arms during performance of the swimming action. The connection member has a first end and a second end. The first end of the connection member is secured relative to the outer end of the pole. The second end of the connection member is secured relative to the engagement member. This combination of the pole, the anchor, the engagement member and the connection member cooperate to provide for a restriction of placement of the swimmer in the body of water during the performance of the swimming action while further providing for a lifting action to the swimmer while in the body of water during the performance of the swimming action.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for an exercise device which will retain a swimmer in a swimming pool in a generally stationary placement where the swimmer will exercise utilizing any desired swimming stroke for any desired duration of time.

Other objects include;

a) to provide for a lifting action to be exerted on the generally stationary swimmer where the stationary swimmer has a sensation generally equaling that obtained during movement through the water during conventional swimming.

b) to provide for a flexing of a pole tethering the swimmer where the stationary swimmer does not experience any sudden or unnatural restraining pressure during each stoke of a series of strokes during performance of the swimming action.

c) to provide for the pole of the swimming exercise device to be anchored within concrete adjacent the body of water.

d) to provide for a flush mount which is generally permanently positioned in a surface of a concrete slab adjacent a swimming pool where the pole of the swimming exercise device may be inserted into the flush mount during times when the swimming exercise device will be utilized and removed from the flush mount when the swimming exercise device will not be utilized.

e) to provide for the flush mount to not interfere with routine use of the swimming pool when the swimming exercise device is not being utilized and the pole of the device is not inserted into the flush mount.

f) to provide for the flush mount to securely retain the pole of the swimming exercise device.

g) to provide for a hand rail mount which may be easily and quickly attached and detached from a hand rail of a swimming pool and which does not adversely effect use of the hand rail of the swimming pool when attached thereto.

h) to provide for the hand rail mount to securely retain the pole of the swimming exercise device.

i) to provide for a pole mount assembly which may be utilized with standard above ground pools where the pole mount assembly does not adversely effect use of the above ground pool.

j) to provide for the pole mount assembly for use with above ground pools to securely retain the pole of the swimming exercise device.

k) to provide for a water weighted pole mount container which may be utilized with pools where it is not desirable and/or is not possible to utilize any of the other pole mounting methods.

l) to provide for the water weighted pole mount container to securely retain the pole of the swimming exercise device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 6*a* and FIG. 6*b* are opposing perspective views of a component of a hand rail mount.

FIG. 7*a* and FIG. 7*b* are opposing perspective views of another component of the hand rail mount.

FIG. 10 is a perspective view of an additional component of the hand rail mount.

FIG. 11 is a perspective view of an additional component of the hand rail mount.

FIG. 12 is a perspective view of an additional component of the hand rail mount.

FIG. 14 is a perspective view of an above ground swimming pool with a suitable embodiment of the swimming exercise device positioned thereabout.

FIG. 15 is an enlarged perspective view of the pole receiving portion.

FIG. 16 is an enlarged perspective view of a ground spike.

DESCRIPTION

Figure 1:
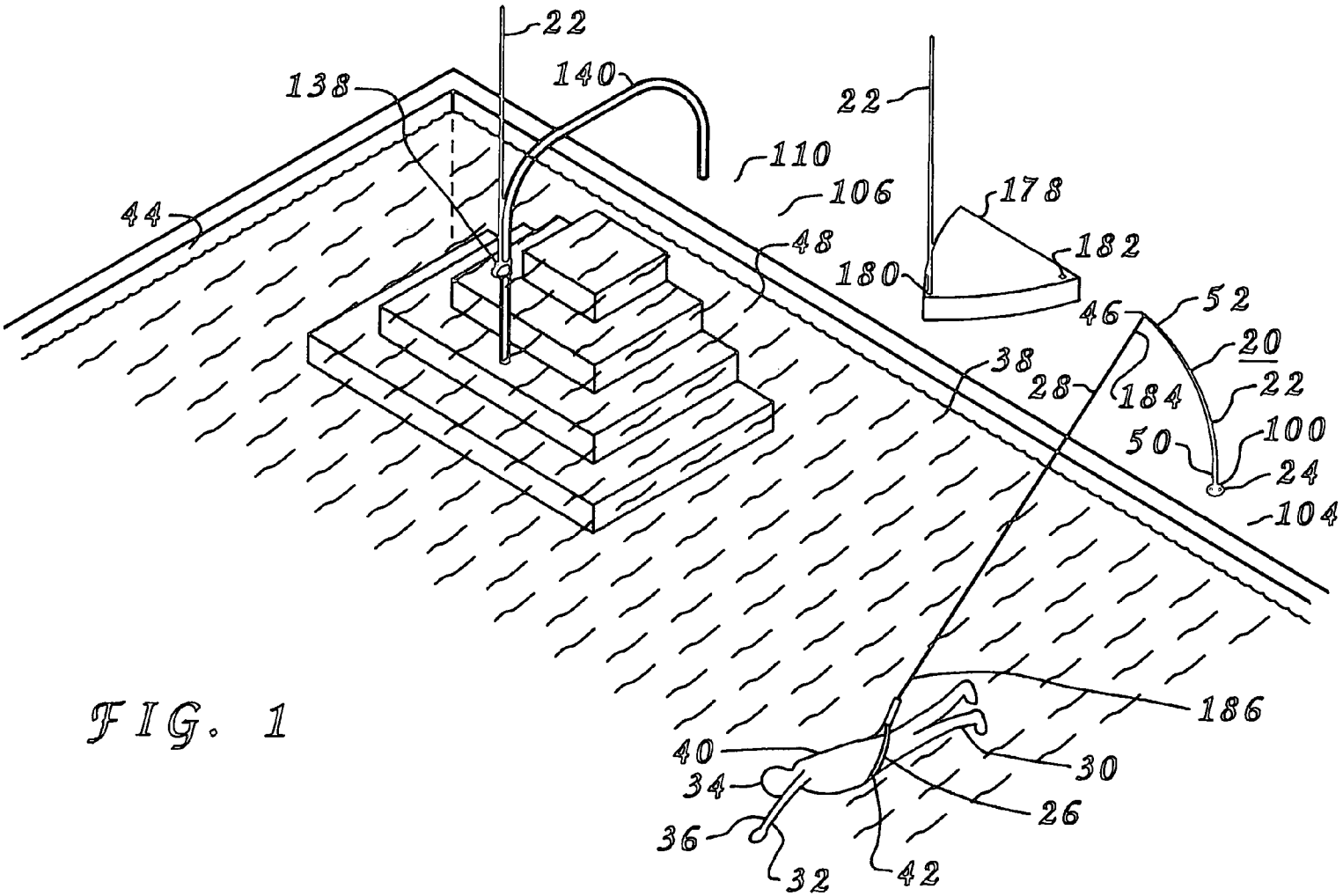
FIG. 1 is a perspective view of a body of water have three (3) swimming exercise devices of the present invention positioned thereabout.
Figure 2:
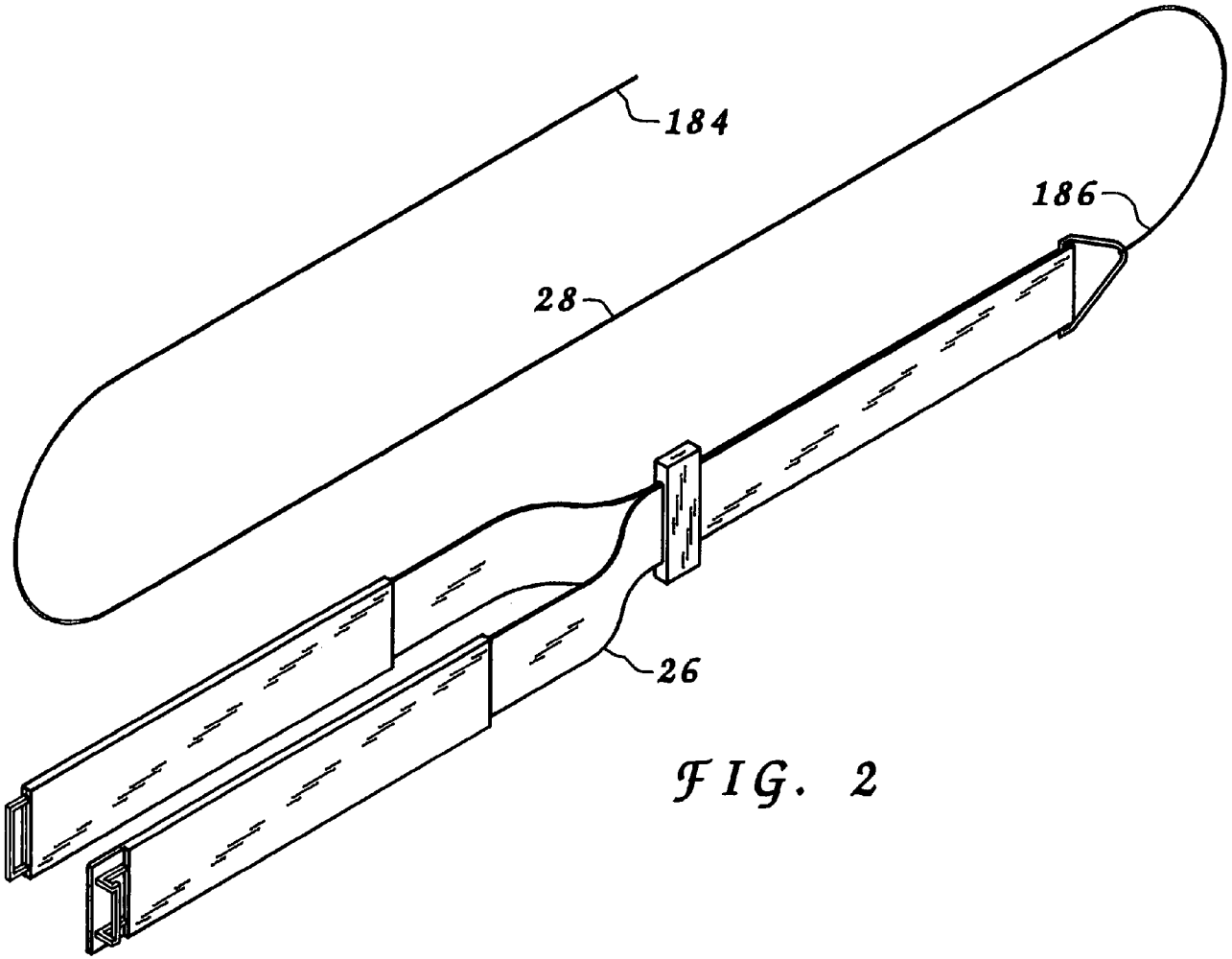
FIG. 2 is a perspective view of an engagement member and a connection member of the swimming exercise device.
Figure 3A:
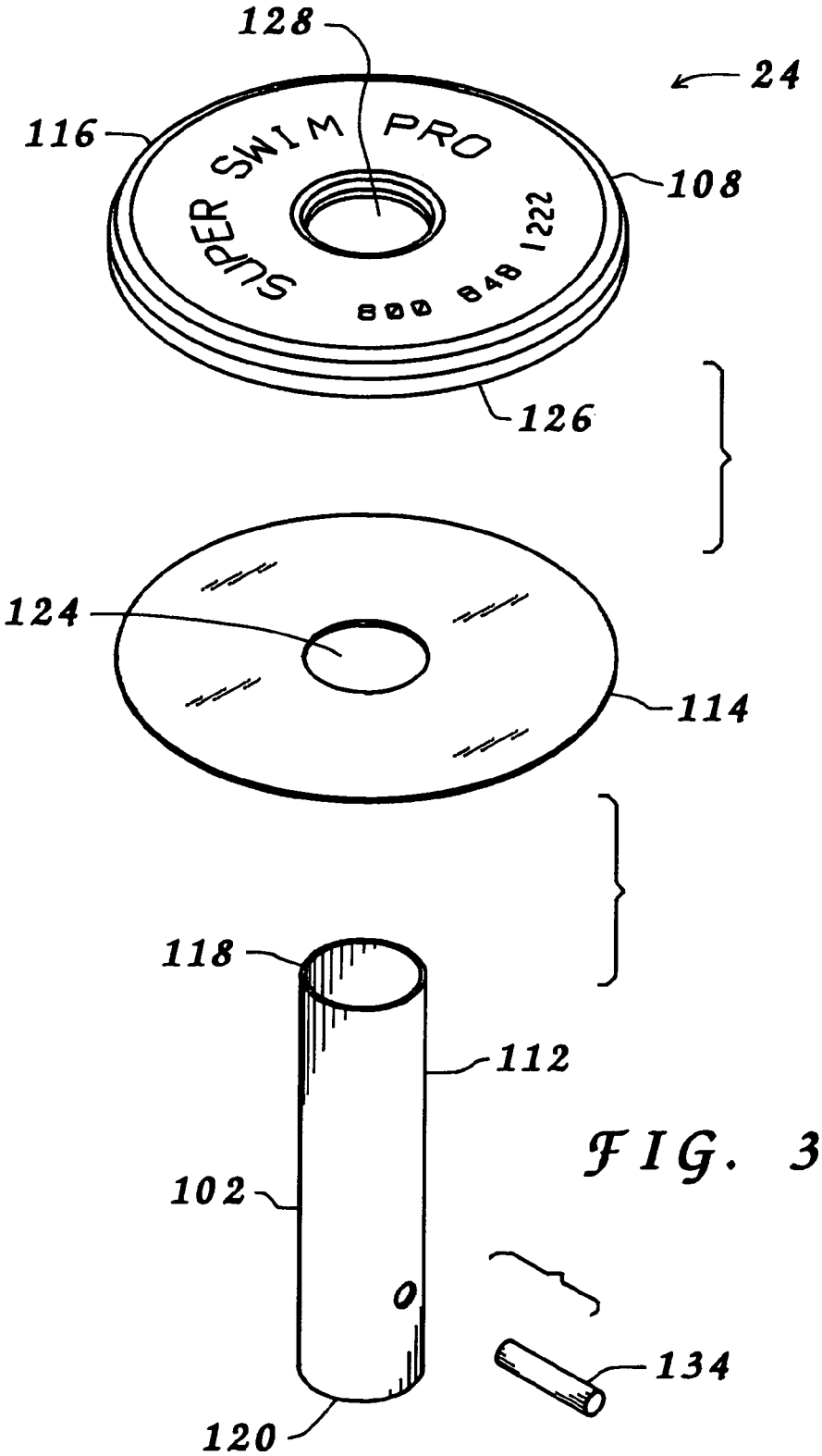
FIG. 3*a* and FIG. 3*b* are opposing exploded perspective views of the components of a pole mount.
Figure 3B:
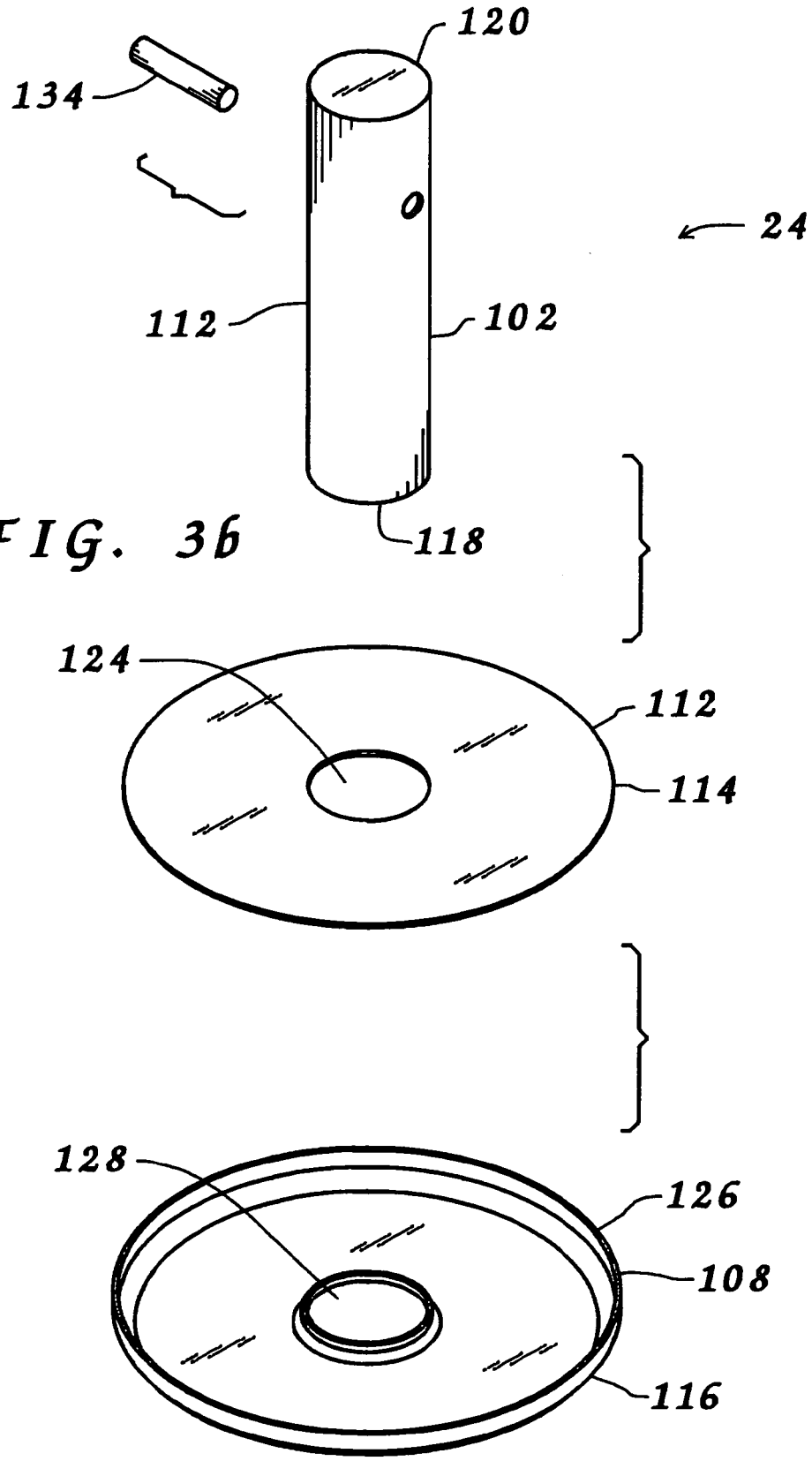
Figure 4A:
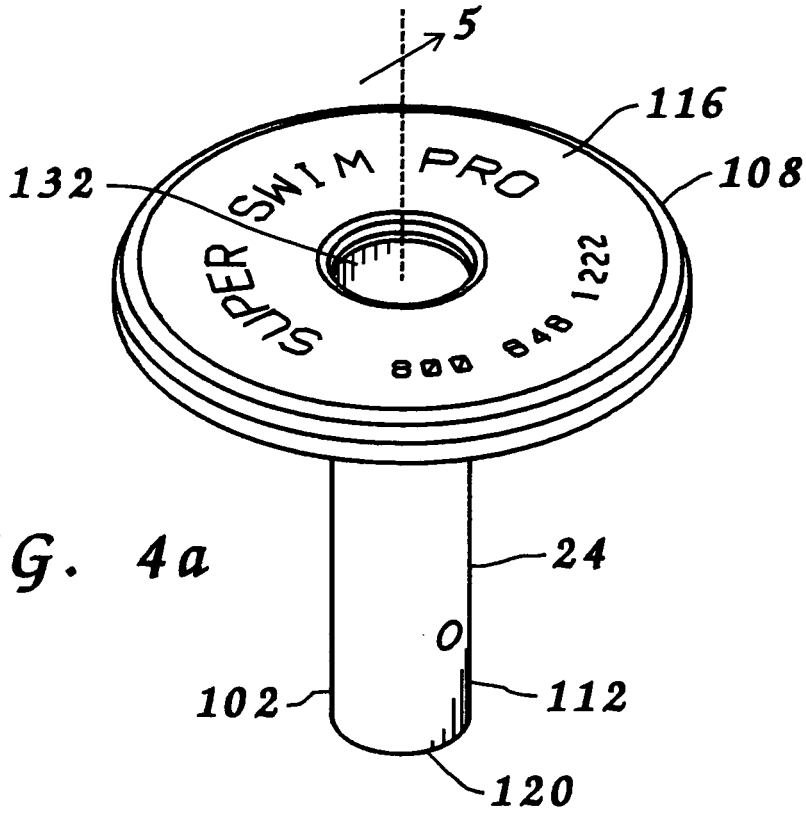
FIG. 4*a* and FIG. 4*b* are opposing perspective views of the pole mount following assembly from the components depicted in FIG. 3*a* and FIG. 3*b*.
Figure 4B:
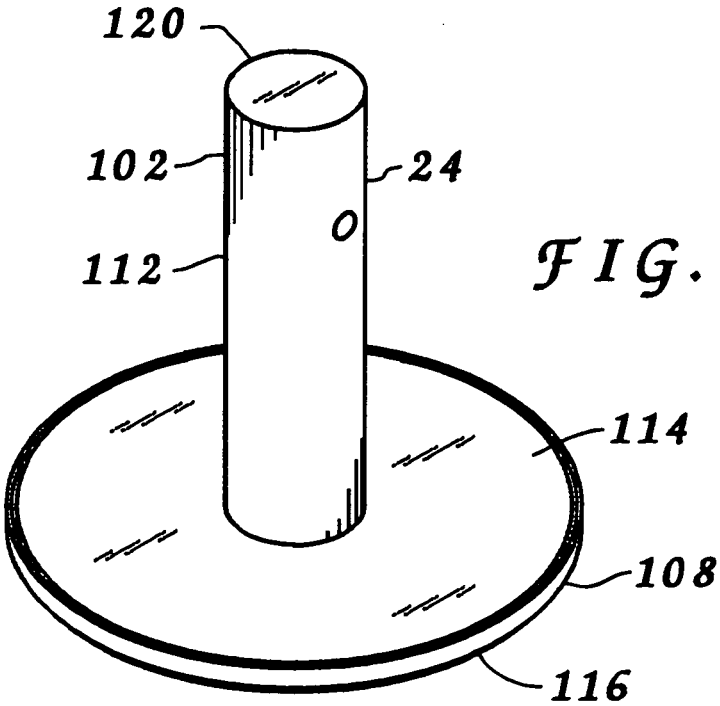

Many different systems having features of the present invention are possible. The following description describes the preferred embodiment of select features of those systems and various combinations thereof. These features may be deployed in various combinations to arrive at various desired working configurations of systems.

Reference is hereafter made to the drawings where like reference numerals refer to like parts throughout the various views.

The present invention provides for a person to perform a swimming based exercise in a generally stationary position within a body of water while experiencing all of the benefits of free movement swimming. In order to provide these benefits structural components cooperate to perform various required functions. The required functions include placement restriction, lifting action and resilient motion. Numerous structural arrangements are available to perform each of these functions and may be deployed in various combinations. An anchoring of the pole relative to the body of water, in combination with other structural components, provides for the desired placement restriction of the swimmer within the body of water. The lifting action provides the swimmer with the sensation of free swimming while being retained in a generally fixed location within the body of water. During performance of the swimming action the swimmer will be making the strokes associated with a specific swimming style in a repetitive manner. It being understood that many swimming styles may be utilized with the present invention. During performance of each stroke for any respective swimming style, as is true for conventional free swimming, various degrees of forward force will be applied by the swimmer within the water during a specific point within each of the strokes. During conventional free swimming these variations in propulsion force within each repetitive cycle of strokes would have no noticeable effect upon the swimmer. When the strokes are performed in a tethered manner it is desirable to provide for a certain degree of resilient motion at some location within the tether assembly to maintain a generally uniform pressure between the swimmer and the components of the assembly contacting the swimmer. While this resilient motion may be accommodated within various of the components, or even a combination of components, it has been discovered that the best component to provide this feature is the pole. Additionally, it has been discovered that it is best to restrict this flex of the pole to the uppermost portion of the pole. This is accomplished in the preferred embodiment by providing a taper to the pole, as is conventionally known in fishing poles, where a diminishing of diametric measurement along the length of the pole restricts the flex to the outermost extent of the pole. Of course, if desired, it is possible to provide certain portions of the pole to have a uniform diametric measurement rather than having a taper along the entire length of the pole.

FIG. 1 depicts a swimming exercise device 20 having a pole 22, means to retain pole 22, in the form of a pole mount 24, an engagement member 26 and a connection member 28. Swimming exercise device 20 functions to allow a generally free movement of legs 30 and arms 32 of a swimmer 34 during performance of a swimming action 36 by swimmer 34 within a body of water 38 while swimmer 34 is being restricted to a generally stationary position 40 in body of water 38.

Pole 22, engagement member 26 and connection member 28 cooperate to provide for restriction of placement of swimmer 34 in body of water 38 during performance of swimming action 36 while further providing for a lifting action 42 to swimmer 34 while in body of water 38 during performance of swimming action 36. The combination of location placement with the lifting action provides for an excellent exercise session which is extremely beneficial to overall health yet is both fun to perform and safe to perform.

The present invention provides for swimmer 34 to be retained in stationary position 40 within body of water 38, such as a swimming pool 44, while also providing a certain amount of lift within swimming pool 44 during performance of swimming action 36. To this end of providing for the retention in stationary position 40 pole 22 provides for securement to a fixed position relative to body of water 38. Pole 22 also provides for a certain amount of resilient motion, or flex, which is providing the resistance to swimmer 34 during performance of swimming action 36. To the end of providing the lift during performance of the swimming action it is necessary to provide for elevation of a connection point 46 of pole 22 for connection member 28 above a surface 48 of swimming pool 44.

A pole will be provided which will perform several important functions. The pole will provide for an attachment location for the connection member elevated well above the surface of the body of water. This elevated attachment location in combination with an angle of the connection member will provide the desired lifting action to the swimmer during performance of the swimming action. Additionally, a resilient flexibility of the pole will provide for resilient motion of swimmer 34 within swimming pool 44. Pole has a securing end 50, an outer end 52 and a resilient flexibility along a portion of pole 22 at least near outer end 52. Preferably, pole 22 has a gradual and consistent taper, as depicted, from securing end 50 to outer end 52. Pole 22 may be constructed from many suitable materials.

It is a requirement that some arrangement be provided to retain the securing end of the pole relative to the body of water. This may be provided by merely utilizing existing structures about the body of water or, more preferably, will involve providing dedicated structural components which will be fixedly secured, at least temporarily, about the body of water.

It is possible to provide for at least the pole of the present invention to remain generally permanently positioned relative to the body of water even when not being utilized for performance of the swimming action. More preferably, the pole will be removed when not being utilized for performance of the swimming action. To this end it is desirable that the pole be slidably insertable and removeable relative to a pole mount. Many variations of pole mounts are possible with various embodiments depicted in the various views.

FIG. 1 and FIG. 3*a* through FIG. 5 depict pole mount 24 as the means to retain securing end 50 of pole 22 in a fixed position 100 relative to body of water 38. Pole mount 24 has a portion 102 which penetrates concrete 104 of concrete pad 106 subsequent to an installation of pole mount 24. Pole mount 24 has a portion 108 which extends slightly above a surface 110 of concrete 104 of concrete pad 106 subsequent to the installation of pole mount 24. Pole mount 24 has a tube portion 112, a planar panel portion 114 and a bowl panel portion 116. Tube portion 112 has an upper end 118 and a lower end 120 subsequent to installation of pole mount 24 relative to concrete pad 106. Planar panel portion 114 has an outer perimeter edge 122 and an aperture 124 therethrough. Bowl panel portion 116 has an outer perimeter edge 126 and an aperture 128 therethrough. Tube portion 112 slidably receives a portion of securing end 50 of pole 22 of swimming exercise device 20 during performance of swimming action. Pole mount 24 has an opening 132 to receive pole 22. A spanning member 134 extends across tube portion 112, see FIG. 5, spaced slightly from lower end 120 but in close proximity to lower end 120. Spanning member 134 contacts pole 22 when inserted in pole mount 24 where pole 22 may not contact lower end 120 of tube portion 112. This arrangement prevents damage to lower end 120 of tube portion 112 by pole 22.

Figure 5:
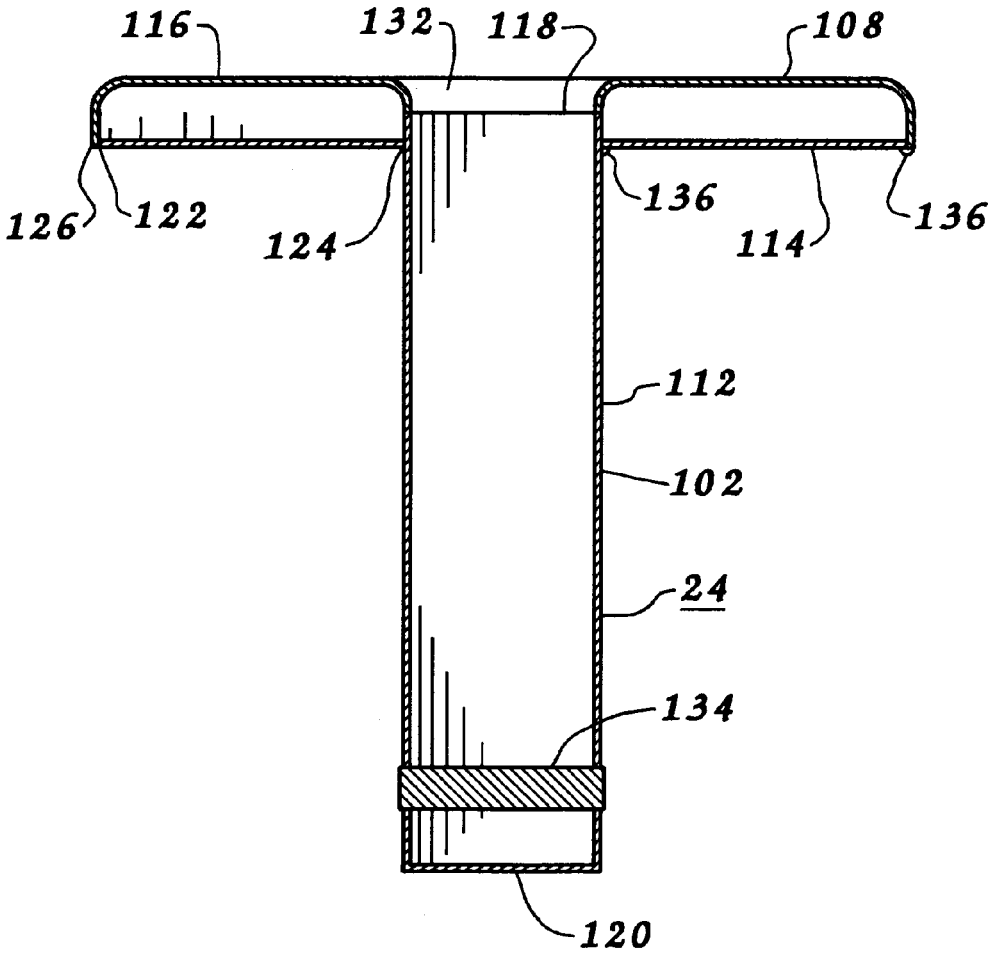
FIG. 5 is a sectional view of the pole mount as taken from the section line '5' shown in FIG. 4*a*.
Figure 8A:
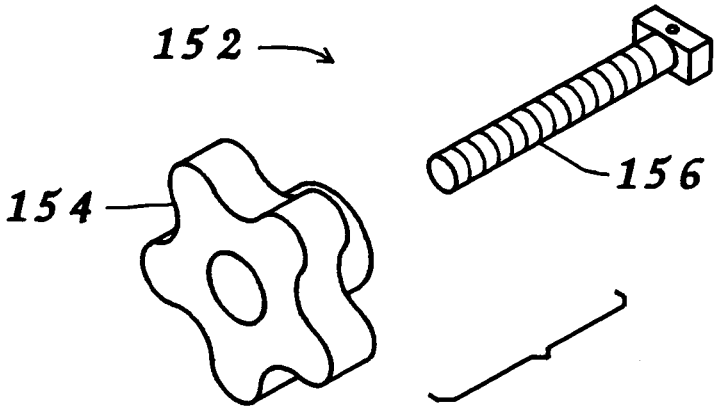
FIG. 8*a* and FIG. 8*b* are opposing perspective views of additional components of the hand rail mount and depicted in a detached arrangement.
Figure 8B:
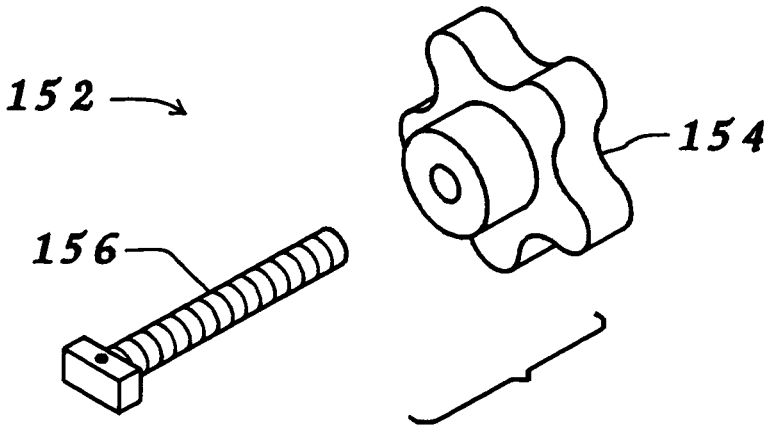
Figure 9:
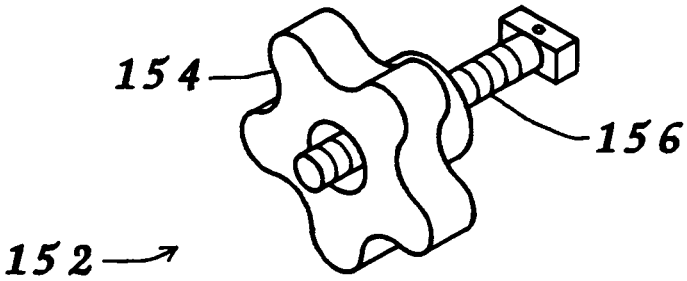
FIG. 9 is a perspective view of the components depicted in FIG. 8*a* and FIG. 8*b* in an assembled arrangement.

Referring now to FIG. 5, pole mount 24 is constructed where tube portion 112 penetrates aperture 124 of planar panel portion 114 and is secured thereat utilizing any suitable securement method, such as welds 136. Upper end 118 of tube portion 112 is positioned in close proximity to aperture 128 of bowl panel portion 116 and is secured thereat utilizing any suitable securement method, such as welds 136. Outer perimeter edge 126 of bowl panel portion 116 is in close proximity to outer perimeter edge 122 of planar panel portion 114 and is secured thereat utilizing any suitable securement method, such as welds 136.

FIG. 1 depicts a hand rail mount 138 which may easily be installed on, and which may easily be removed from, a hand rail 140 associated with swimming pool 44. Hand rail mount 138 completely surrounds hand rail 140 subsequent to installation of hand rail mount 138 and securely is retained at the point of installation for subsequent retention of other components of the present invention.

Figure 13A:
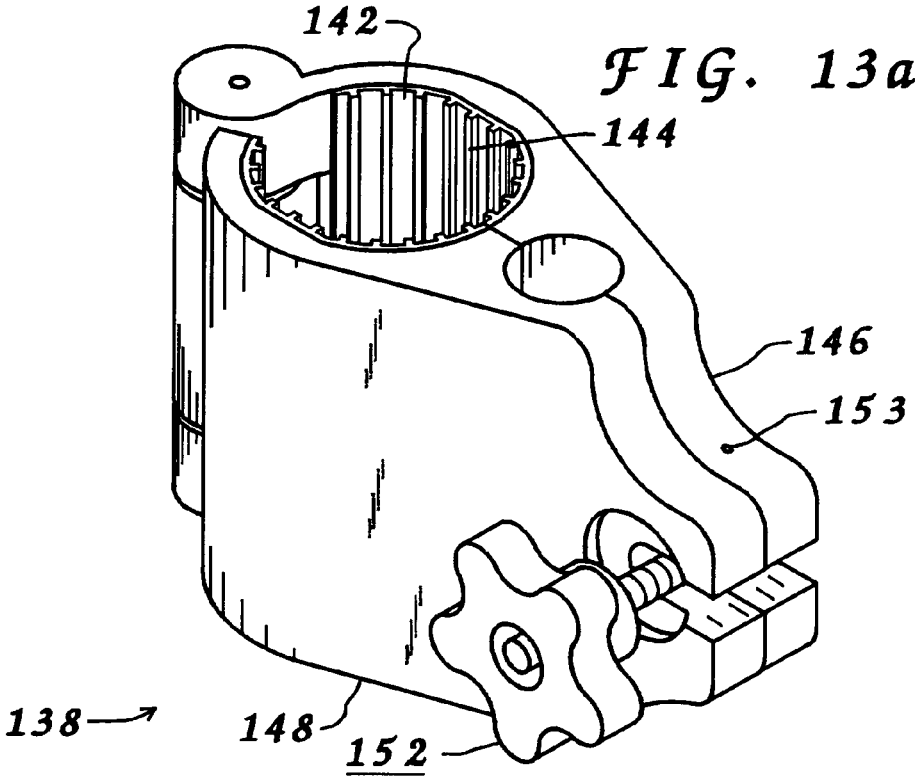
FIG. 13*a* and FIG. 13*b* are perspective views of the hand rail mount subsequent to assembly and depicted in a closed orientation, unlocked and locked respectively.
Figure 13B:
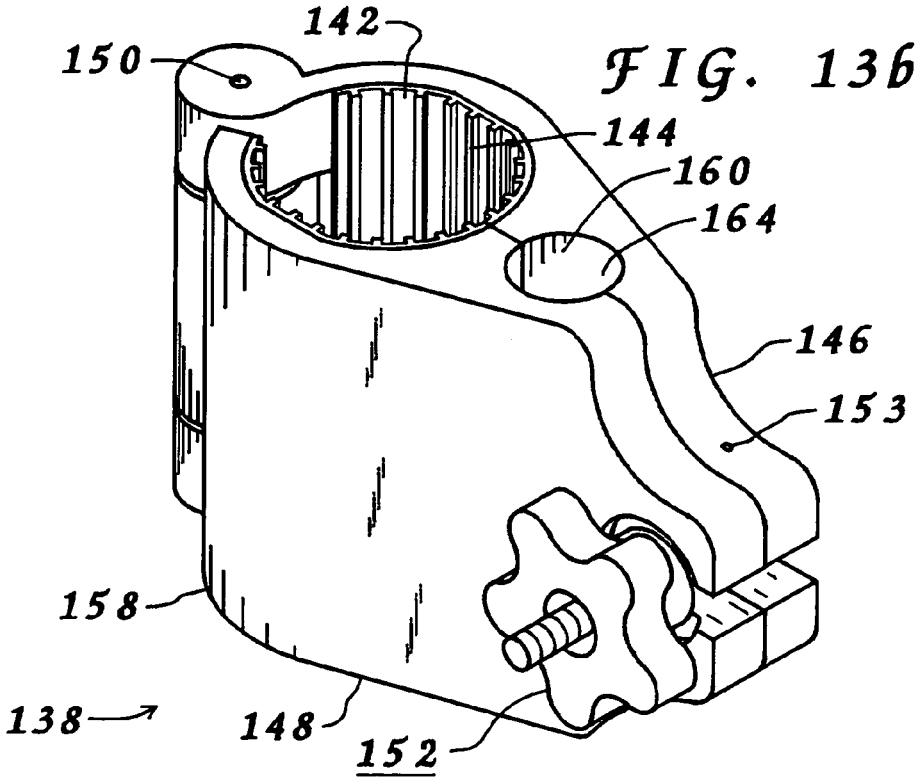

Referring now to FIG. 1 and FIG. 6*a* through FIG. 13*b*, hand rail mount 138 has a hand rail contact surface 142 which makes contact with hand rail 140 subsequent to installation. Hand rail contact surface 142 of hand rail mount 138 is formed of opposing pieces of a compressible resilient material 144, see FIG. 10 Hand rail mount 138 has a first body member 146, a second body member 148 and a hinge member 150. First body member 146 and second body member 148 are attached to hinge member 150. This provides for first body member 146 and second body member 148 to pivot relative to each other at hinge member 150 to provide for placement over hand rail 140 during installation of hand rail mount 138 and to provide for removal from hand rail 140. A pivotal threaded anchor 152 is pivotally attached to first body member 146 utilizing a securing pin 153. Pivotal threaded anchor 152 has a threaded coupling member 154 and a threaded portion 156. Threaded coupling member 154 is selectively displaceable along threaded portion 156 to provide for pressure bearing contact of pivotal threaded anchor 152 with second body member 148 utilizing manipulation of threaded coupling member 154 for movement along threaded portion 156 of pivotal threaded anchor 152. This pressure bearing contact, see FIG. 13*b*, provides for first body member 146 and second body member 148 to be retained in contact with any desired locational position on hand rail 140.

Hand rail mount 138 has an installed orientation 158, see FIG. 13*b*, where a pole penetration recess 160 is positioned thereon while hand rail mount 138 is in installed orientation 158. Pole penetration recess 160 has a generally closed bottom 162 while hand rail mount 138 is in installed orientation 158. Pole penetration recess 160 slidably receives a portion of securing end 50 of pole 22 during performance of the swimming action. Pole penetration recess 160 has an outer perimeter 164 along a depth while in installed orientation 158 with outer perimeter 164 of pole penetration recess 160 generally symmetrically disposed on first body member 146 and second body member 148.

FIG. 14 depicts an above ground pool pole mount 170 capable of being installed with above ground pools. Above ground pool pole mount 170 has a pole receiving portion 172 of sufficient length to span from the ground to at least the top of the side of the above ground pool. An upper anchor 174 and a lower anchor 176 provide for securement of pole receiving portion 172 relative to a structural brace of the above ground pool. In the most preferred embodiment of above ground pool pole mount 170 pole receiving portion 172 significantly penetrates the ground adjacent the above ground pool to provide additional structural support. FIG. 15 depicts pole receiving portion 172 which has a similar passageway at a lower extent to receive a portion of a ground spike 226, see FIG. 16, following a partial insertion of ground spike 226 into the ground adjacent the above ground pool.

Numerous variations in construction exist for above ground pools. It is possible to provide the benefits of the present invention to all of these structural configurations. Many of these types of pools have a plurality of structural supports extending upward from ground level to an upper perimeter structural member. These structural supports will reinforce the upper perimeter structural member. Many of these structural supports extend generally vertical and have a uniform cross section profile along a significant portion of the support. Certain designs utilize structural supports which expand during elevational travel and/or which are offset from vertical. It is possible to provide for engagement of a select structural support to anchor the pole of the present invention. This engagement may also engage other structures of the above ground pool. It is possible to provide a detachable pole mount which surrounds the structural support and has features to prevent elevational displacement along the structural support and to prevent axial displacement about the structural support. While such mounts may be designed for relatively permanent attachment it is desirable to provide for the mount to be removable such as for the hand rail mount disclosed herein.

FIG. 1 depicts a water weight pole mount 178 having a pole mount recess 180, an interior to contain water and a drain plug 182 to permit filling and draining of water weight pole mount 178 with water. Water weight pole mount 178, when generally filled with water, will securely retain pole 22 within pole mount recess 180. Pole 22 may be removed from water weight pole mount 178 when not being utilized with the present invention.

An engagement member will be provided to contact the swimmer while leaving the swimmer free to manipulate their legs and arms during performance of the swimming action. This may involve mere surrounding contact of the torso of the swimmer, as depicted in FIG. 1 by engagement member 26, or may involve a more elaborate harness type system. In the preferred embodiment depicted engagement member 26 is of a sufficient width and is padded for comfort during performance of the swimming action.

A connection member will be provided to connect the engagement member contacting and retaining the swimmer to the pole. Various structural components may be utilized to perform this function. FIG. 1 depict connection member 28 having a first end 184 and a second end 186 with first end 184 secured relative to outer end 52 of pole 22 and second end 186 secured relative to engagement member 26. It is possible to provide for the connection member to be of a construction to have an elastic property to provide the resilient motion function of the present invention. In the preferred embodiment depicted connection member 28 is merely a conventional nylon strand braided cord.

A system will keep track of numerous information and store that information for subsequent use during an exercise session utilizing equipment having features of applicant's various inventions. In order to perform this feature it is necessary to place a measuring component somewhere were stress will be applied to the component in response to the swimmer's exercise activity. Ideally this will occur at, or near, the outer end of the pole where the connection member attaches. This placement provides for the measuring component to be at a point where pressure routinely occurs during the exercise session and which is at the highest elevation above the body of water.

Numerous types of information will be available during each exercise session. Examples include number of strokes, pulling force exerted during each stroke, duration of time for each stroke, the various levels of force applied within each stroke and many other examples. Additionally, other information will preferably be gathered at least at the start of an exercise session and at the end of the exercise session.

Examples include heart rate, such as number of beats per minute, and respiration rate, such as number of cycles of inhaling and exhaling per minute. Blood pressure is information which can be extremely valuable, especially when analyzed historically.

When physiological information is gathered the components that take those measurements can be worn by the swimmer, or otherwise attached to the swimmer. Alternatively, the components can be placed near the location where the exercise session is occurring and the swimmer may interact with those components on some predetermined frequency.

It is known for swimmers to have an exercise session with a series of exertion sessions where the swimmer actively swims in a generally stationary position with intervening rest periods. Preferably components will take these measurements as compared to the swimmer manually timing such rates and manually recording such rates. This is to eliminate the tendency for people to occasionally forget to perform certain desired steps. When a measurement component is utilized which is not worn by the swimmer during the exercise session it is desirable to have some audio reminder arrangement available.

It is possible to determine average force exerted, minimum force exerted, maximum force exerted, average force exerted for beginning predetermined number of strokes and average force exerted for ending predetermined number of strokes. Of course a predetermined number of strokes at the beginning of the session and at the end of the session could be ignored from the calculations if desired.

Computations can be performed, in real time during an exercise session or historically, to determine how a specific swimmer is performing. Such information is invaluable to the swimmer to inform them if they are obtaining their specific goals. Typically someone starting to use the SuperSwim products will wish to see steady improvement in their performance as they grow stronger and more physically fit. Typically someone who has been using the products for a long time will have reached their ideal fitness level and wish to maintain that peak condition.

When real time feedback is provided it can act to remind the swimmer to complete a desired exercise level for that specific session. Examples include that a predetermined number of stroke cycles have been performed or that a certain predetermined level of force is being reached or that a predetermined length of time has been utilized for the session.

It is possible to analyze a swimmers performance for specific types of swimming strokes and make comparisons to the performance of other swimmers or to some predefined ideal stroke. Feedback from this type of analysis can inform a swimmer if they are exerting excessive force at certain points in the stroke cycle or exerting insufficient force at certain points in the stroke cycle. Additionally, such analysis can inform the swimmer as to what portion of a stroke cycle suffers at certain points within a predefined exercise session.

Numerous methods are known in the art to input data into electronic components and generally any known method can be utilized with the session monitoring components. Preferably the swimmer will be able to inform the component of what type of swimming stroke is being utilized. Similarly numerous methods are known in the art to transfer data from one electronic component to another and generally any known method can be utilized for data transfer between components. Wireless transmission of data when components are positioned near the body of water or when the user is wet from swimming is preferred.

Components can provide the swimmer with real time feedback on their activity level compared to a predefined desired or target activity level. One example involves an audio signal which sounds a first warning if the swimmer is exerting too little force during a specific portion of a session and which sounds a second warning, unique from the first warning, if the swimmer is exerting too much force during a specific portion of a session. These unique audio warnings provide for the swimmer to make adjustments to their exertion levels without interrupting or otherwise interfering with the session. Similar audio signals can be utilized to inform the swimmer to switch from one swimming style to another swimming style within an exercise session at the conclusion of some predefined event. Such signaling may involve elapse of a period of time, completion of a set number of stroke cycles, upon reaching a target force exertion level or upon reaching a physiological level, such as reaching a target heart rate.

Many types of sensors are known in the art. It is possible to utilize multiple sensors, or a sensor package which makes multiple measurements. While pulling force is one of the most important standards being examined, many other conditions can be utilized individually or in some desired combination. Examples include sensors which can determine acceleration and deceleration. Due to the arcing effect of poles having features of the present invention it is possible to measure angular orientation to a known orientation, such as true horizontal or true vertical. From this measurement it can then be determined how much movement is occurring to the anchor point of the connection member to the pole. This can then be converted into movement of the swimmer within the body of water during each swimming stroke cycle.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A swimming exercise device for a swimmer to allow generally free movement of legs and arms during performance of a swimming action by the swimmer within a body of water while the swimmer is being restricted to a generally stationary position in the body of water, the swimming exercise device comprising:

a) a pole having a securing end, an outer end and a resilient flexibility along a portion of the pole at least near the outer end;

b) an engagement member to contact the swimmer while leaving the swimmer free to manipulate their legs and arms during performance of the swimming action;

c) a connection member having a first end and a second end with the first end secured relative to the outer end of the pole and the second end secured relative to the engagement member;

d) an anchor to provide for retaining the securing end of the pole relative to the body of water, the anchor having an assembly having a portion which penetrates the concrete of the concrete pad situated adjacent the body of water subsequent to an installation of the anchor, the anchor further comprises:

i) a tube portion having an upper end and a lower end subsequent to an installation of the pole mount relative to the concrete pad;

ii) a planar panel portion having an outer perimeter edge and an aperture therethrough;

iii) a bowl panel portion having an outer perimeter edge and an aperture therethrough;

wherein the tube portion penetrates the aperture of the planar panel portion and is secured thereat and wherein the upper end of the tube portion is positioned in close proximity to the aperture of the bowl panel portion and is secured thereat and wherein the outer perimeter edge of the bowl panel portion is in close proximity to the outer perimeter edge of the planar panel portion and is secured thereat;

and wherein the anchor, the pole, the engagement member and the connection member cooperate to provide for a restriction of placement of the swimmer in the body of water during the performance of the swimming action while further providing for a lifting action to the swimmer while in the body of water during the performance of the swimming action.

2. The swimming exercise device defined in claim 1 wherein the anchor further comprises a portion which extends slightly above a surface of the concrete subsequent to the installation of the anchor.

3. The swimming exercise device defined in claim 1 wherein the assembly which penetrates the concrete pad is the tube portion having a generally round cross section and which slidably receives a portion of the securing end of the pole of the swimming exercise device during the performance of the swimming action.

4. A swimming exercise device for a swimmer to allow generally free movement of legs and arms during performance of a swimming action by the swimmer within a body of water while the swimmer is being restricted to a generally stationary position in the body of water, the swimming exercise device comprising:

a) a pole having a securing end, an outer end and a resilient flexibility along a portion of the pole at least near the outer end;

b) an engagement member to contact the swimmer while leaving the swimmer free to manipulate their legs and arms during performance of the swimming action;

c) a connection member having a first end and a second end with the first end secured relative to the outer end of the pole and the second end secured relative to the engagement member;

d) an anchor to provide for retaining the securing end of the pole relative to the body of water, the anchor having an assembly having a portion which penetrates the concrete of the concrete pad situated adjacent the body of water subsequent to an installation of the anchor, the anchor further comprises:

i) a tube portion having an upper end and a lower end subsequent to an installation of the pole mount relative to the concrete pad and wherein the lower end of the tube portion is closed;

ii) a planar panel portion having an outer perimeter edge and an aperture therethrough;

iii) a bowl panel portion having an outer perimeter edge and an aperture therethrough;

wherein the tube portion penetrates the aperture of the planar panel portion and is secured thereat and wherein the upper end of the tube portion is positioned in close proximity to the aperture of the bowl panel portion and is secured thereat and wherein the outer perimeter edge of the bowl panel portion is in close proximity to the outer perimeter edge of the planar panel portion and is secured thereat;

and wherein the anchor, the pole, the engagement member and the connection member cooperate to provide for a restriction of placement of the swimmer in the body of water during the performance of the swimming action while further providing for a lifting action to the swimmer while in the body of water during the performance of the swimming action.

5. The swimming exercise device defined in claim 4 wherein the anchor further comprises a portion which extends slightly above a surface of the concrete subsequent to the installation of the anchor.

6. The swimming exercise device defined in claim 4 wherein the assembly which penetrates the concrete pad is the tube portion having a generally round cross section and which slidably receives a portion of the securing end of the pole of the swimming exercise device during the performance of the swimming action.

7. A swimming exercise device for a swimmer to allow generally free movement of legs and arms during performance of a swimming action by the swimmer within a body of water while the swimmer is being restricted to a generally stationary position in the body of water, the swimming exercise device comprising:

a) a pole having a securing end, an outer end and a resilient flexibility along a portion of the pole at least near the outer end;

b) an engagement member to contact the swimmer while leaving the swimmer free to manipulate their legs and arms during performance of the swimming action;

c) a connection member having a first end and a second end with the first end secured relative to the outer end of the pole and the second end secured relative to the engagement member;

d) an anchor to provide for retaining the securing end of the pole relative to the body of water, the anchor having an assembly having a portion which penetrates the concrete of the concrete pad situated adjacent the body of water subsequent to an installation of the anchor, the anchor further comprises:

i) a tube portion having an upper end, a lower end, the upper end and the lower end oriented subsequent to an installation of the pole mount relative to the concrete pad and a spanning member crossing an interior of the tube and positioned slightly above the lower end;

ii) a planar panel portion having an outer perimeter edge and an aperture therethrough;

iii) a bowl panel portion having an outer perimeter edge and an aperture therethrough;

wherein the tube portion penetrates the aperture of the planar panel portion and is secured thereat and wherein the upper end of the tube portion is positioned in close proximity to the aperture of the bowl panel portion and is secured thereat and wherein the outer perimeter edge of the bowl panel portion is in close proximity to the outer perimeter edge of the planar panel portion and is secured thereat;

and wherein the anchor, the pole, the engagement member and the connection member cooperate to provide for a restriction of placement of the swimmer in the body of water during the performance of the swimming action while further providing for a lifting action to the swimmer while in the body of water during the performance of the swimming action.

8. The swimming exercise device defined in claim 7 wherein the anchor further comprises a portion which extends slightly above a surface of the concrete subsequent to the installation of the anchor.

9. The swimming exercise device defined in claim 7 wherein the assembly which penetrates the concrete pad is the tube portion having a generally round cross section and which slidably receives a portion of the securing end of the pole of the swimming exercise device during the performance of the swimming action.

* * * * *